US012742407B2

(12) United States Patent
Kurpejovic et al.

(10) Patent No.: US 12,742,407 B2
(45) Date of Patent: Sep. 22, 2026

(54) DISPLAY DRIVING DEVICE COMPRISING AN EMISSION CIRCUIT AND POSITIVE FEEDBACK CIRCUIT

(71) Applicant: Purem GmbH, Neunkirchen (DE)

(72) Inventors: Enver Kurpejovic, Kirchheim unter Teck (DE); Florian Friedrich, Oestringen (DE); Manuel Notter, Schwaikheim (DE)

(73) Assignee: Purem GmbH, Neunkirchen (DE)

( * ) Notice: Subject to any disclaimer, the term of this patent is extended or adjusted under 35 U.S.C. 154(b) by 70 days.

(21) Appl. No.: 18/543,938

(22) Filed: Dec. 18, 2023

(65) Prior Publication Data

US 2024/0200483 A1 Jun. 20, 2024

(30) Foreign Application Priority Data

Dec. 19, 2022 (DE) ..... 10 2022 133 786.3

(51) Int. Cl.
*F01N 3/28* (2006.01)
*F01N 3/029* (2006.01)
(Continued)

(52) U.S. Cl.
CPC ..... *F01N 3/2892* (2013.01); *F01N 3/2066* (2013.01); *F01N 3/0293* (2013.01);
(Continued)

(58) Field of Classification Search
CPC .... F01N 3/2892; F01N 3/2066; F01N 3/0293; F01N 3/2821; F01N 13/009;
(Continued)

(56) References Cited

U.S. PATENT DOCUMENTS 11,767,778 B1 * 9/2023 Choi ..... F01N 3/2066 60/285
2010/0083643 A1 * 4/2010 Hayashi ..... F01N 13/0093 60/297
2020/0271035 A1 * 8/2020 Gattani ..... B01F 23/2326

FOREIGN PATENT DOCUMENTS

DE 202015102092 U1 * 9/2015 ..... F01N 13/02
DE 102015106876 A1 * 11/2015 ..... F01N 13/009
(Continued)

OTHER PUBLICATIONS

Machine Translation of DE 102015106876A1 (Year: 2015).*
Machine Translation of DE 202015102092U1 (Year: 2015).*

*Primary Examiner* — Brandon D Lee
(74) *Attorney, Agent, or Firm* — Walter Ottesen, P.A.

(57) ABSTRACT

A mixing section is for an exhaust system of an internal combustion engine. The mixing section intermixes exhaust gas and reagent and includes a mixing-section housing, enclosing a mixing chamber with a housing base. At least one exhaust-gas inlet opening admits exhaust gas into the mixing chamber and is provided in the housing base. A reagent dispenser dispenses reagent into the mixing chamber substantially in a main dispensing direction. The mixing section also includes a reagent-receiving arrangement for receiving reagent dispensed into the mixing chamber and the reagent-receiving arrangement includes a plurality of reagent receivers succeeding one another in the main dispensing direction. Each reagent receiver defines a reagent-receiving area positioned facing toward the reagent dispenser.

19 Claims, 3 Drawing Sheets

(51) Int. Cl.
*F01N 3/20* (2006.01)
*F01N 13/00* (2010.01)

(52) U.S. Cl.
CPC ..... *F01N 3/2821* (2013.01); *F01N 13/009* (2014.06); *F01N 2240/20* (2013.01); *F01N 2610/00* (2013.01); *F01N 2610/14* (2013.01); *F01N 2610/1453* (2013.01)

(58) Field of Classification Search
CPC ..... F01N 2240/20; F01N 2610/00; F01N 2610/14; F01N 2610/1453; F01N 3/00; F01N 2610/02
See application file for complete search history.

(56) References Cited

FOREIGN PATENT DOCUMENTS

| | | |
|---|---|---|
| EP | 3 425 180 A1 | 1/2019 |
| FR | 2 977 632 A1 | 1/2013 |

* cited by examiner

DISPLAY DRIVING DEVICE COMPRISING AN EMISSION CIRCUIT AND POSITIVE FEEDBACK CIRCUIT

CROSS-REFERENCE TO RELATED APPLICATIONS

This application claims priority of German patent application no. 10 2022 133 786.3, filed Dec. 19, 2022, the entire content of which is incorporated herein by reference.

TECHNICAL FIELD

The present disclosure relates to a mixing section for an exhaust system of an internal combustion engine, for intermixing exhaust gas and reagent.

BACKGROUND

With a view to lessening the pollutant content in exhaust gas emitted by an internal combustion engine, it is known to inject a reagent, for instance a urea/water solution, into the exhaust gas. In a catalytically active exhaust-gas treatment arrangement, for instance in an SCR catalytic converter, a catalytic reaction resulting in the lessening of the pollutant content, for instance a selective catalytic reduction, is carried out using the reagent.

SUMMARY

It is an object of the present disclosure to provide a mixing section for an exhaust system of an internal combustion engine, with which, with a small construction-space requirement, an efficient mixing of exhaust gas and of reagent injected into the mixing section is obtained.

In accordance with the disclosure, this object is, for example, achieved via a mixing section for an exhaust system of an internal combustion engine, for intermixing exhaust gas and reagent, including:

- a mixing-section housing, enclosing a mixing chamber, with a housing base, wherein at least one exhaust-gas inlet opening for admission of exhaust gas into the mixing chamber is provided in the housing base,
- a reagent-dispensing unit for dispensing reagent into the mixing chamber substantially in a main dispensing direction,
- a reagent-receiving arrangement for receiving reagent dispensed into the mixing chamber, the reagent-receiving arrangement including a plurality of reagent-receiving elements succeeding one another in the main dispensing direction, each reagent-receiving element exhibiting a reagent-receiving area positioned facing toward the reagent-dispensing unit.

By virtue of the wetting of the reagent-receiving elements arranged in the mixing chamber with the reagent injected into the mixing chamber, a comparatively large surface is utilized in order to evaporate the reagent, generally injected in liquid form as a spray mist with a large number of reagent droplets, and to mix it with the exhaust gas vortexed in the mixing chamber.

For a structurally simple configuration, at least one reagent-receiving element, preferentially each reagent-receiving element, may have been formed in plate-like manner and may exhibit a substantially flat reagent-receiving area.

In order to avoid a mutual shielding of the reagent-receiving elements, it is proposed that a plurality of passage openings have been formed in at least one reagent-receiving element, preferentially in each reagent-receiving element.

An efficient wetting of the reagent-receiving areas can be obtained by the reagent-receiving area in the case of at least one reagent-receiving element, preferentially in the case of each reagent-receiving element, being oriented substantially orthogonally to the main dispensing direction or/and being oriented substantially parallel to a center axis of at least one exhaust-gas inlet opening. Furthermore, there may be provision that at least two reagent-receiving areas, preferentially all the reagent-receiving areas, are substantially parallel to one another.

A mutual shielding of the reagent-receiving elements against a wetting with the reagent injected into the mixing chamber can be further prevented if in the case of at least two reagent-receiving elements directly adjacent to one another, preferentially in the case of all the reagent-receiving elements directly adjacent to one another, the reagent-receiving area of the reagent-receiving element positioned closer to the reagent-dispensing unit is smaller than the reagent-receiving area of the reagent-receiving element positioned further away from the reagent-dispensing unit.

For the purpose of obtaining a compact style of construction, it is proposed that in the case of at least two reagent-receiving elements directly adjacent to one another, preferentially in the case of all the reagent-receiving elements directly adjacent to one another, the reagent-receiving area of the reagent-receiving element positioned closer to the reagent-dispensing unit is substantially completely overlapped at right angles to the main dispensing direction by the reagent-receiving area of the reagent-receiving element positioned further away from the reagent-dispensing unit.

A reliable wetting of reagent-receiving elements positioned further away from the reagent-dispensing unit can be guaranteed if a size of the reagent-receiving areas of the reagent-receiving elements increases in the main dispensing direction.

For a uniform wetting of the entire reagent-receiving arrangement, it is proposed that a dispensing location of the reagent-dispensing unit in at least one direction at right angles to the main dispensing direction is positioned substantially centrally with respect to an outer peripheral contour of the reagent-receiving arrangement.

For this purpose, there may be provision that the outer peripheral contour of the reagent-receiving arrangement corresponds substantially to an outer peripheral contour of the reagent-receiving element having the largest reagent-receiving area.

At least one exhaust-gas inlet opening, preferentially each exhaust-gas inlet opening, may be elongated in the direction of a longitudinal axis thereof preferentially substantially parallel to the main dispensing direction, as a result of which an excessive throttling of the stream of exhaust gas is avoided. In this connection, it is particularly advantageous if at least two exhaust-gas inlet openings elongated in the direction of a respective longitudinal axis thereof with longitudinal axes substantially parallel to one another and overlapping one another in the direction of the longitudinal axes thereof at least partially, preferentially substantially completely, have been provided in the housing base.

For a stable mounting of the reagent-receiving elements, the latter may be supported on the housing base between the at least two exhaust-gas inlet openings.

If at least one reagent-receiving element, preferentially each reagent-receiving element, extends at least partially across at least one exhaust-gas inlet opening at right angles to the main dispensing direction, an efficient interaction of a reagent-receiving element positioned in such a manner with the stream of exhaust gas is guaranteed, in particular also for the purpose of heating the reagent-receiving element. In this connection, it is particularly advantageous if all the reagent-receiving elements at right angles to the main dispensing direction extend at least partially across the same exhaust-gas inlet opening.

For the purpose of obtaining a turbulence, assisting the intermixing, of the exhaust gas introduced into the mixing chamber, the mixing-section housing may exhibit an exhaust-gas-deflecting wall, situated opposite the housing base, with a concave inner deflecting surface facing toward the mixing chamber.

If the inner deflecting surface exhibits a vertex region with maximum spacing from the housing base, and a substantially vertical projection of the vertex region onto the housing base is situated between two exhaust-gas inlet openings, two exhaust-gas vortices oriented contrary to one another are generated in the mixing chamber, as a result of which the intermixing of exhaust gas with reagent injected into the mixing chamber, or evaporating from the reagent-receiving areas, is further assisted.

In order to be able to utilize the turbulence of exhaust gas in the mixing chamber efficiently for the purpose of intermixing with reagent injected into the mixing chamber, it is further proposed that the vertex region is elongated in the direction of the longitudinal axis of the at least one exhaust-gas inlet opening or/and in the main dispensing direction.

For the purpose of dispensing the mixture of exhaust gas and reagent generated in the mixing section, the mixing-section housing may exhibit an exhaust-gas outlet opening, a main inflow direction of exhaust gas flowing through the at least one exhaust-gas inlet opening being substantially orthogonal to a main outflow direction of exhaust gas flowing through the exhaust-gas outlet opening.

The disclosure further relates to an exhaust system for an internal combustion engine, including a mixing section constructed in accordance with the disclosure.

At least one exhaust-gas treatment arrangement, preferentially including an oxidation catalytic converter or/and a particle filter, may have been arranged upstream of the mixing section. For the purpose of causing the mixture of exhaust gas and reagent to react, at least one exhaust-gas treatment arrangement, preferentially including an SCR catalytic converter, may have been arranged downstream of the mixing section.

BRIEF DESCRIPTION OF DRAWINGS

The invention will now be described with reference to the drawings wherein.

DETAILED DESCRIPTION

Figure 1:
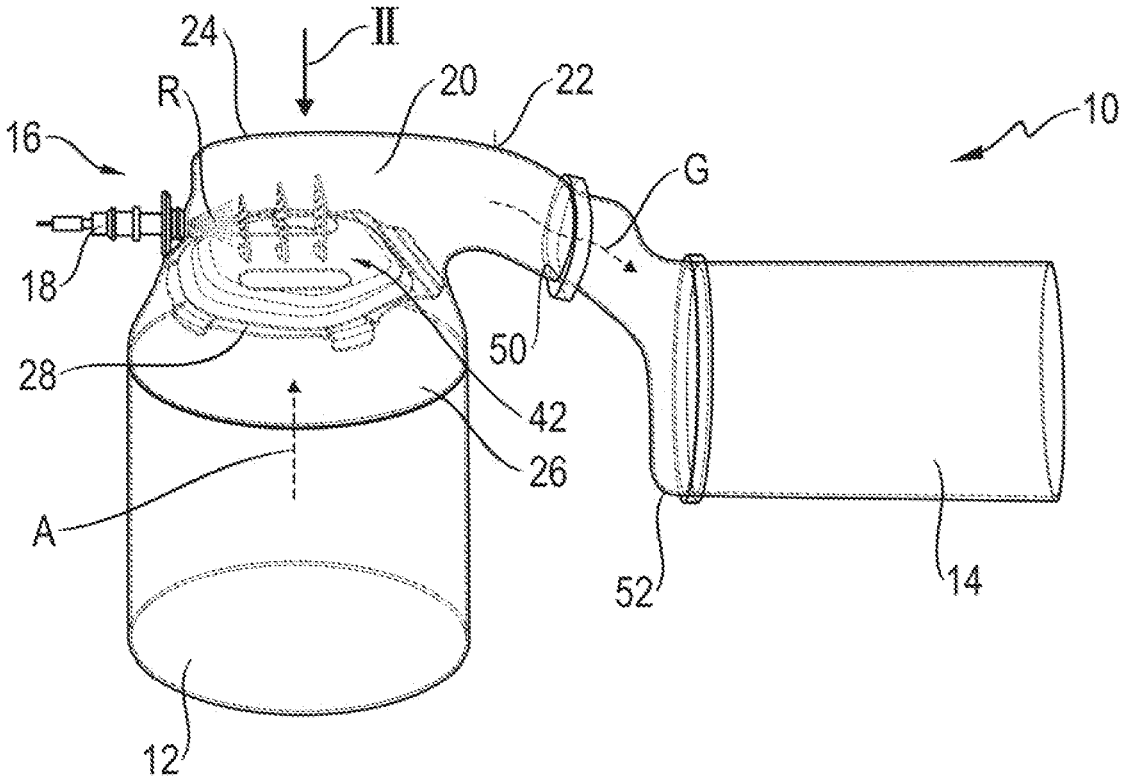
FIG. 1 shows a side view of a part of an exhaust system including a mixing section.

FIGS. 1 to 4 show a subregion of an exhaust system, denoted generally by 10, of an internal combustion engine in a vehicle. This subregion of the exhaust system 10 includes a mixing section, denoted generally by 16, between an upstream exhaust-gas treatment arrangement 12—including, for instance, an oxidation catalytic converter or/and a particle filter—and a downstream exhaust-gas treatment arrangement 14—including, for instance, an SCR catalytic converter. In the mixing section 16, exhaust gas A leaving the exhaust-gas treatment arrangement 12 is intermixed, in the manner described below, with a reagent R injected into a mixing chamber 20 by a reagent-dispensing unit 18, generally also designated as an injector, so that a mixture G of exhaust gas A and reagent R flows into the downstream exhaust-gas treatment arrangement 14.

The mixing section 16 includes a mixing-section housing denoted generally by 22. The mixing-section housing 22 includes a housing part 24 formed substantially in dome-like manner and provided, for instance, as a sheet-metal formed part in one piece or in multiple pieces. The housing part 24 may have been linked in its upstream end region 26 to the upstream exhaust-gas treatment arrangement 12.

The mixing-section housing 22 further includes a housing base 28, formed substantially in plate-like manner and likewise provided, for instance, as a sheet-metal formed part. The housing base 28, represented in more detailed manner in FIGS. 5 and 6, may exhibit a plurality of connecting tabs 30 in an outer peripheral region, with which the housing base 28 inserted into the housing part 24 can be firmly connected to the housing part 24, for instance by welding or soldering or such like. The housing base 28 and the housing part 24 consequently substantially enclose the mixing chamber 20 formed in the mixing-section housing 22. Furthermore, the reagent-dispensing unit 18 is supported on the housing part 24 in such a manner that it dispenses the reagent R into the mixing chamber 20 substantially in a main dispensing direction H which may be oriented parallel to an approximately flat surface 32 of the housing base 28. It should be pointed out that the main dispensing direction H may, for instance, correspond to the direction of a center axis of a spray cone K of the reagent R dispensed by the reagent-dispensing unit 18. For instance, the main dispensing direction H may correspond substantially to a central dispensing direction of the reagent R.

In the embodiment represented, two exhaust-gas inlet openings $\mathbf{34}_1$, $\mathbf{34}_2$ have been formed in the housing base 28. Center axes $M_1$, $M_2$ of the exhaust-gas inlet openings $\mathbf{34}_1$, $\mathbf{34}_2$ are oriented substantially orthogonally to the substantially flat surface 32 of the housing base 28. The exhaust gas A entering the mixing chamber 20 from the upstream exhaust-gas treatment arrangement 12 flows through the exhaust-gas inlet openings $\mathbf{34}_1$, $\mathbf{34}_2$ substantially in a respective main inflow direction $E_1$, $E_2$, these directions being approximately parallel to the respective center axis $M_1$, $M_2$ of the opening.

The two exhaust-gas inlet openings $\mathbf{34}_1$, $\mathbf{34}_2$ are arranged in the housing base 28 in such a manner that the longitudinal axes $L_1$, $L_2$ thereof are substantially orthogonal to the respective center axes $M_1$, $M_2$ thereof and are substantially parallel to one another and preferentially also to the main dispensing direction H. Furthermore, the exhaust-gas inlet openings $\mathbf{34}_1$, $\mathbf{34}_2$ are positioned in such a way that they overlap one another substantially completely in the direction of their longitudinal axes $L_1$, $L_2$, which may mean that the two exhaust-gas inlet openings $\mathbf{34}_1$, $\mathbf{34}_2$ have substantially the same length in the direction of their respective longitudinal axes $L_1$, $L_2$ and also preferentially have the same width at right angles to the respective longitudinal axis $L_1$, $L_2$.

Figure 4:
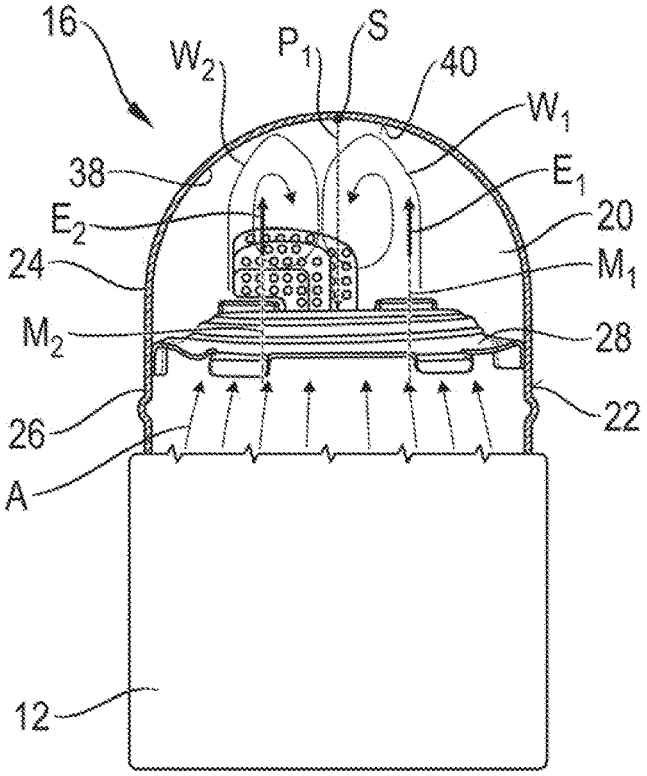
FIG. 4 shows a view, represented partially open, of the mixing section shown in FIG. 3 in direction of view IV indicated in FIG. 3.
Figure 5:
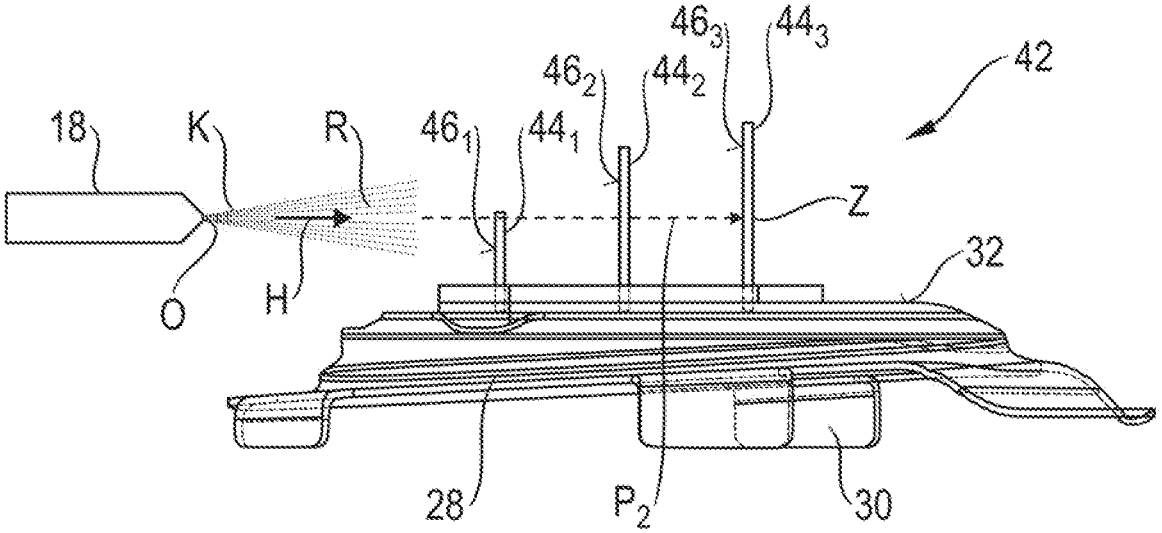
FIG. 5 shows a side view of a housing base of a mixing-section housing with reagent-receiving elements, supported thereon, of a reagent-receiving arrangement; and, FIG. 6 shows a view of the assembly represented in FIG. 5, viewed in a main dispensing direction indicated in FIG. 5.
Figure 6:
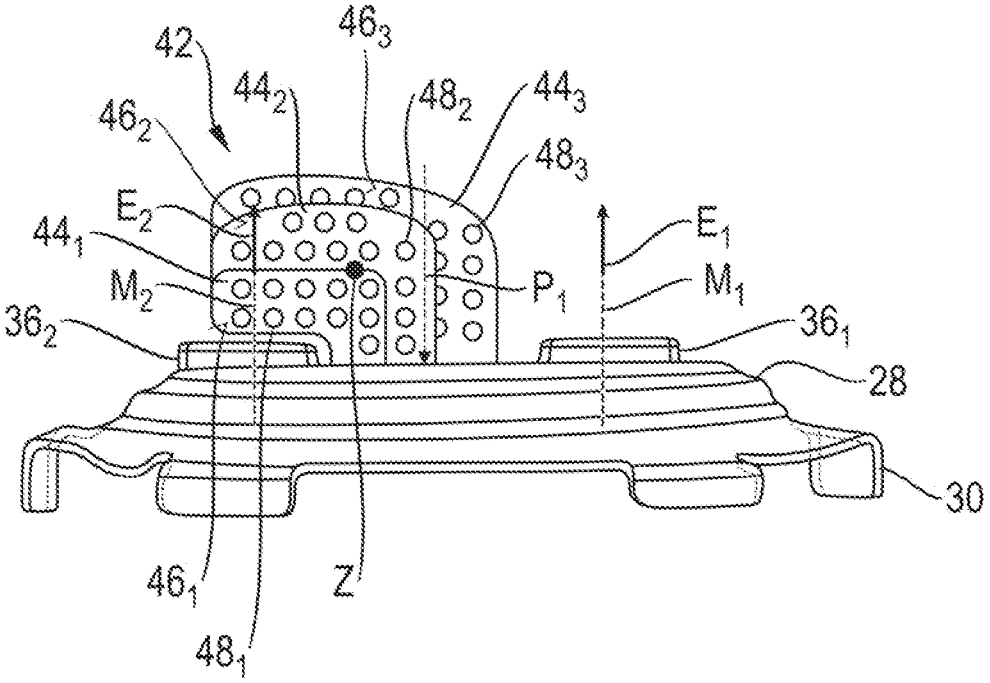

In FIGS. 4 to 6 it can be discerned that each of the exhaust-gas inlet openings $\mathbf{34}_1$, $\mathbf{34}_2$ is surrounded by an opening rim $\mathbf{36}_1$, $\mathbf{36}_2$ oriented in the direction toward the mixing chamber 20 and generated, for instance, by reforming. The opening rims $\mathbf{36}_1$, $\mathbf{36}_2$ assist the defined inflow of the exhaust gas A into the mixing chamber 20 in the respective main inflow direction $E_1$, $E_2$.

The housing part 24 enclosing, together with the housing base 28, the mixing chamber 20 is shaped in dome-like manner, in particular in its region situated opposite the housing base 28, and provides a deflecting wall 38 with an inner deflecting surface 40 facing toward the mixing chamber 20 and concave with respect to the mixing chamber 20. By reason of the dome-like shape, the inner deflecting surface 40 exhibits a vertex region S in which the inner deflecting surface 40 has the maximum spacing from the housing base 28, or from the substantially flat surface 32 thereof. A vertical projection of the vertex region S onto the housing base 28, indicated by a projection arrow $P_1$ in FIG. 4, is situated, as also indicated in FIG. 6, preferentially substantially centrally between the two exhaust-gas inlet openings $\mathbf{34}_1$, $\mathbf{34}_2$, and also in the direction of the longitudinal axes $L_1$, $L_2$ thereof may preferentially be situated substantially in a central region of the exhaust-gas inlet openings $\mathbf{34}_1$, $\mathbf{34}_2$. In principle, the vertex region S may have been configured in such a manner that, as FIG. 3 indicates, it has an elongated contour also in the direction of the main dispensing direction H, or of the longitudinal axes $L_1$, $L_2$ of the openings, with approximately constant spacing from the housing base 28.

By virtue of this structure of the housing part 24 in the region of its deflecting wall 38, the exhaust gas A introduced into the mixing chamber 20 through the exhaust-gas inlet openings $\mathbf{34}_1$, $\mathbf{34}_2$ in the respective main inflow direction $E_1$, $E_2$ is deflected in such a way that two exhaust-gas vortices $W_1$, $W_2$ oriented contrary to one another arise. In the case of the aforementioned linearly extended shape of the vertex region S, these exhaust-gas vortices $W_1$, $W_2$ may also, in principle, have a roller-like structure extended in this direction by reason of the elongated shape of the exhaust-gas inlet openings $\mathbf{34}_1$, $\mathbf{34}_2$ in the same direction.

A reagent-receiving arrangement, denoted generally by 42, is arranged in the mixing chamber 20. In the example represented, the reagent-receiving arrangement 42 includes three reagent-receiving elements $\mathbf{44}_1$, $\mathbf{44}_2$, $\mathbf{44}_3$ formed substantially in plate-like manner, which take the form, for instance, of sheet-metal formed parts. The reagent-receiving elements $\mathbf{44}_1$, $\mathbf{44}_2$, $\mathbf{44}_3$ formed in plate-like manner may, for instance, have been fixed in a region between the two exhaust-gas inlet openings $\mathbf{34}_1$, $\mathbf{34}_2$ by materially closed linkage to the housing base 28.

Each reagent-receiving element $\mathbf{44}_1$, $\mathbf{44}_2$, $\mathbf{44}_3$ exhibits a substantially flat—that is, non-curved—reagent-receiving area $\mathbf{46}_1$, $\mathbf{46}_2$, $\mathbf{46}_3$ oriented facing toward the reagent-dispensing unit 18. The reagent-receiving elements $\mathbf{44}_1$, $\mathbf{44}_2$, $\mathbf{44}_3$ are arranged in the mixing chamber 20 in such a way that the substantially flat, non-curved reagent-receiving areas $\mathbf{46}_1$, $\mathbf{46}_2$, $\mathbf{46}_3$ thereof are oriented substantially orthogonally to the main dispensing direction H and are oriented substantially parallel to the main inflow direction $E_1$, $E_2$ which is present at a respective exhaust-gas inlet opening $\mathbf{34}_1$, $\mathbf{34}_2$, and also to one another. Consequently the reagent-receiving elements $\mathbf{44}_1$, $\mathbf{44}_2$, $\mathbf{44}_3$ do not substantially impede the inflow of exhaust gas A into the mixing chamber 20 but provide a maximum receiving interaction with the reagent R injected into the mixing chamber 20.

The reagent-receiving elements $\mathbf{44}_1$, $\mathbf{44}_2$, $\mathbf{44}_3$, arranged succeeding one another in the main dispensing direction H, have been configured in such a way that the size of the reagent-receiving area $\mathbf{46}_1$, $\mathbf{46}_2$, $\mathbf{46}_3$ respectively provided thereon increases in the direction away from the reagent-dispensing unit 18—that is, substantially also in the main dispensing direction H. Reagent-receiving element $\mathbf{44}_1$ positioned closest to the reagent-dispensing unit 18 exhibits the smallest reagent-receiving area $\mathbf{46}_1$, whereas reagent-receiving element $\mathbf{44}_3$ situated furthest away from the reagent-dispensing unit 18 provides the largest reagent-receiving area $\mathbf{46}_3$.

As can be discerned in particular in FIG. 6, the reagent-receiving elements $\mathbf{44}_1$, $\mathbf{44}_2$, $\mathbf{44}_3$ overlapping one another when viewed in the main dispensing direction H, have approximately the same external peripheral geometry—that is, a substantially rectangular outer peripheral geometry—in particular in the region of their respective reagent-receiving areas $\mathbf{46}_1$, $\mathbf{46}_2$, $\mathbf{46}_3$. The reagent-receiving elements $\mathbf{44}_1$, $\mathbf{44}_2$, $\mathbf{44}_3$ are positioned in such a way that an outer peripheral contour of the reagent-receiving arrangement 42 is substantially defined by the outer peripheral contour of reagent-receiving element $\mathbf{44}_3$ providing the largest reagent-receiving area $\mathbf{46}_3$. This means that reagent-receiving elements $\mathbf{44}_1$, $\mathbf{44}_2$ formed with respective smaller reagent-receiving areas $\mathbf{46}_1$, $\mathbf{46}_2$ at right angles to the main dispensing direction H do not protrude substantially beyond the outer peripheral contour of reagent-receiving element $\mathbf{44}_3$ providing the largest reagent-receiving area $\mathbf{46}_3$. This has the consequence that a center Z, represented in FIG. 6, of the outer peripheral contour of the reagent-receiving arrangement 42 is substantially defined by the central region of reagent-receiving area $\mathbf{46}_{30}$f reagent-receiving element $\mathbf{44}_3$.

In order to obtain an efficient wetting of all the reagent-receiving elements $\mathbf{44}_1$, $\mathbf{44}_2$, $\mathbf{44}_3$ with the reagent R, the reagent-dispensing unit 18 is positioned or oriented in such a way that a dispensing location O at which the reagent R is dispensed in the main dispensing direction H by the reagent-dispensing unit 18 is situated substantially directly opposite the center Z of the outer peripheral contour of the reagent-receiving arrangement 42 when viewed in the main dispensing direction H, this being illustrated in FIG. 5 by a projection arrow $P_2$. As a result, it is guaranteed that the spray cone K, which is substantially symmetrical with respect to the main dispensing direction H in the peripheral direction, covers the outer peripheral contour of the reagent-receiving arrangement 42 substantially uniformly, and consequently the reagent-receiving areas $\mathbf{46}_1$, $\mathbf{46}_2$, $\mathbf{46}_3$ can be wetted approximately uniformly substantially over their entire surface.

In order to avoid, as far as possible, a mutual shielding of the reagent-dispensing elements $\mathbf{44}_1$, $\mathbf{44}_2$, $\mathbf{44}_3$ succeeding one another in the main dispensing direction H, a large number of passage openings $\mathbf{48}_1$, $\mathbf{48}_2$, $\mathbf{48}_3$ may have been provided in each of these elements. Some of the reagent R which is to flow onto a respective reagent-receiving element $\mathbf{44}_1$, $\mathbf{44}_2$, $\mathbf{44}_3$ is consequently not received on these elements but in the region of the passage openings $\mathbf{48}_1$, $\mathbf{48}_2$, $\mathbf{48}_3$ flows through the latter and can consequently, on the one hand, wet reagent-receiving elements $\mathbf{44}_2$, $\mathbf{44}_3$ then following in the main dispensing direction H or can mix downstream of the last reagent-receiving element $\mathbf{44}_3$ with the exhaust gas A flowing in this volume region in the mixing chamber 20.

Figure 2:
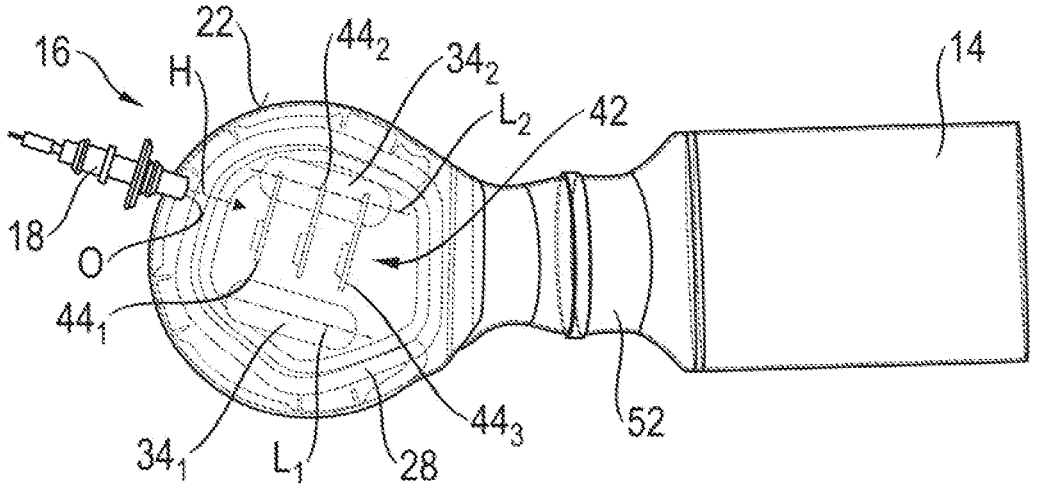
FIG. 2 shows a view of the exhaust system shown in FIG. 1 in direction of view II indicated in FIG. 1.
Figure 3:
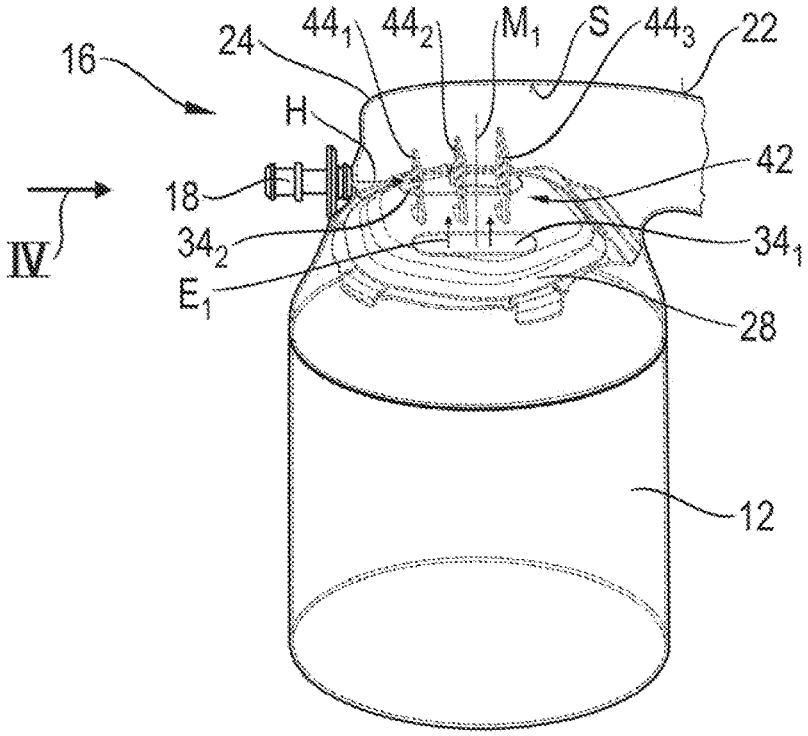
FIG. 3 shows, on an enlarged scale, the region of the exhaust system shown FIG. 1 including the mixing section.

In particular in FIGS. 2 and 6, it can be clearly discerned that the reagent-receiving elements $\mathbf{44}_1$, $\mathbf{44}_2$, $\mathbf{44}_3$ are positioned on the housing base 28 in such a way that they extend at right angles to the main dispensing direction H, or at right angles to the longitudinal axes $L_1$, $L_2$ of the openings, into the region of exhaust-gas inlet opening $\mathbf{34}_2$. On the one hand, this intensifies the thermal interaction of the reagent-receiving elements $\mathbf{44}_1$, $\mathbf{44}_2$, $\mathbf{44}_3$ with the exhaust gas A flowing into the mixing chamber 20, so that a rapid heating of the reagent-receiving elements $\mathbf{44}_1$, $\mathbf{44}_2$, $\mathbf{44}_3$, assisting the evaporation of reagent, is guaranteed. On the other hand, this positioning of the reagent-receiving elements $\mathbf{44}_1$, $\mathbf{44}_2$, $\mathbf{44}_3$ makes possible the aforementioned alignment of the center Z of the outer peripheral contour of the reagent-receiving arrangement 42 with the dispensing location O, or with the main dispensing direction H, coordinated with the positioning of the reagent-dispensing unit 18 on the housing part 24. In order to intensify further the thermal interaction with the exhaust gas A, or to be able to provide even larger reagent-receiving areas, the reagent-receiving elements $\mathbf{44}_1$, $\mathbf{44}_2$, $\mathbf{44}_3$ might have been formed in such a manner that they also extend into the region of exhaust-gas inlet opening $\mathbf{34}_1$. This might be advantageous, in particular, when the reagent-dispensing unit 18 is positioned on the mixing-section housing 22 in such a manner that the dispensing location O is situated substantially centrally between the two exhaust-gas inlet openings $\mathbf{34}_1$, $\mathbf{34}_2$.

The mixture G of exhaust gas A and reagent R formed in the mixing chamber 20 leaves the mixing-section housing 22 in the region of an exhaust-gas outlet opening 50 substantially in a main outflow direction S which is oriented approximately orthogonally to the main inflow directions $E_1$, $E_2$. This results in a compact structure of the mixing section 16, or of the entire exhaust system 10, and, by reason of the deflection of the flow by approximately 90° arising in the region of the mixing chamber 20 and superimposed on the turbulence, results in a further mixing of exhaust gas A and reagent R already taken up in the exhaust gas. Consequently it is guaranteed that an exhaust gas A that has been intermixed substantially uniformly with reagent R flows into the downstream exhaust-gas treatment arrangement 14, for instance through a transition housing 52, and consequently can enter into interaction within the arrangement, distributed over the cross-section thereof, in substantially uniform manner with the catalytically active material provided therein for the purpose of implementing the stipulated exhaust-gas cleanup function.

It should be pointed out that various variations can be undertaken in respect of the mixing section presented in the foregoing on the basis of an embodiment. For instance, more than the three reagent-receiving elements presented might have been provided. In the sequence of reagent-receiving elements, two reagent-receiving elements directly adjacent to one another having equally large reagent-receiving areas, for instance, might also have been formed. It should be pointed out that with respect to the orientation, elucidated in the foregoing, of various components or configuration aspects—for instance, orthogonal or parallel to one another—the respective orientations may deviate slightly from an exact parallel or orthogonal orientation in the given case, without this resulting in an impairment of the intermixing of exhaust gas and reagent to be brought about by the interaction of the various system regions.

It is understood that the foregoing description is that of the preferred embodiments of the invention and that various changes and modifications may be made thereto without departing from the spirit and scope of the invention as defined in the appended claims.

The invention claimed is:

1. A mixing section for an exhaust system of an internal combustion engine, the mixing section being for intermixing exhaust gas and reagent, the mixing section comprising:

a mixing-section housing enclosing a mixing chamber and having a housing base;

said housing base having at least one exhaust-gas inlet opening for admitting exhaust gas into said mixing chamber;

a reagent dispenser for dispensing the reagent into said mixing chamber in a main dispensing direction (H);

a reagent-receiving arrangement for receiving the reagent dispensed into said mixing chamber;

said reagent-receiving arrangement including a plurality of reagent receivers disposed one behind another in said main dispensing direction (H);

each one of said plurality of reagent receivers defining a reagent-receiving area positioned to face toward said reagent dispenser;

at least two of said reagent receivers being directly adjacent to one another in said main dispensing direction (H), the reagent-receiving area of the reagent receiver of said at least two of said reagent receivers positioned closer to said reagent dispenser being completely overlapped at right angles to said main dispensing direction (H) by the reagent-receiving area of the reagent receiver of said at least two of said reagent receivers positioned further away from said reagent dispenser;

a size of the reagent-receiving areas of the respective reagent receivers increasing in said main dispensing direction (H);

an outer peripheral contour of the reagent-receiving arrangement corresponding to an outer peripheral contour of the reagent receiver having the largest reagent-receiving area; and said reagent dispenser having a dispensing location (O) positioned in each direction at right angles to said main dispensing direction (H) centrally with respect to said outer peripheral contour of the reagent-receiving arrangement.

2. The mixing section of claim 1, wherein at least one of the following applies:

i) at least one of said reagent receivers is formed in a plate-like manner and defines a substantially flat reagent-receiving area; and;

ii) at least one reagent receiver has a plurality of passage openings formed therein.

3. The mixing section of claim 1, wherein said at least one exhaust-gas inlet opening defines a center axis and at least one of the following applies:

i) for at least one of said reagent receivers, the reagent-receiving area thereof is oriented substantially orthogonally to said main dispensing direction (H); and, ii) for at least one of said reagent receivers, said reagent-receiving area is oriented substantially parallel to said center axis; and, at least two of said reagent-receiving areas are substantially parallel to one another.

4. The mixing section of claim 1, wherein at least two of said reagent receivers are directly mutually adjacent and the reagent-receiving area of the reagent receiver positioned closer to said reagent dispenser is smaller than the reagent-receiving area of the reagent receiver positioned further away from said reagent dispenser.

5. The mixing section of claim 1, wherein said at least one exhaust-gas inlet opening defines a longitudinal axis and is elongated in the direction of said longitudinal axis which is substantially parallel to said main dispensing direction (H).

6. The mixing section of claim 1, further comprising at least two of said exhaust-gas inlet openings formed in said housing base; said exhaust-gas inlet openings having respective longitudinal axes substantially parallel to said main dispensing direction (H) and said exhaust-gas inlet openings being elongated in a direction of corresponding ones of said longitudinal axes; and, said longitudinal axes being substantially parallel to one another and overlapping one another.

7. The mixing section of claim 6, wherein said reagent receivers are supported on said housing base between said at least two exhaust-gas inlet openings.

8. The mixing section of claim 6, wherein at least one of the following applies:

i) each of said reagent receivers extends at least partially across at least one of said exhaust-gas inlet openings at right angles to said main dispensing direction (H); and, ii) all of said reagent receivers extend at least partially across the same one of said exhaust-gas inlet openings at right angles to said main dispensing direction (H).

9. The mixing section of claim 1, wherein at least one of said reagent receivers extends at least partially across said at least one exhaust-gas inlet opening at right angles to said main dispensing direction (H).

10. The mixing section of claim 1, wherein said mixing-section housing has an exhaust-gas-deflecting wall situated opposite said housing base and defines a concave inner deflecting surface facing toward said mixing chamber.

11. The mixing section of claim 10, further comprising at least two of said exhaust-gas inlet openings; said concave inner deflecting surface exhibiting a vertex region(S) with maximum spacing from said housing base; and, a substantially vertical projection of the vertex region(S) onto said housing base being situated between said two exhaust-gas inlet openings.

12. The mixing section of claim 11, wherein said vertex region(S) is elongated in the direction of the longitudinal axis of one of said at least one exhaust-gas inlet opening and/or in the direction of the main dispensing direction (H).

13. The mixing section of claim 1, wherein said mixing-section housing has an exhaust-gas outlet opening; and, a main inflow direction of the exhaust gas flowing through said at least one exhaust-gas inlet opening is substantially orthogonal to a main outflow direction of exhaust gas and/or reagent flowing through said exhaust-gas outlet opening.

14. An exhaust system for an internal combustion engine comprising:

a conduit for conducting exhaust gas away from said internal combustion engine; and, a mixing section for intermixing exhaust gas and a reagent;

said mixing section including:

a mixing-section housing enclosing a mixing chamber and having a housing base;

said housing base having at least one exhaust-gas inlet opening for admitting exhaust gas into said mixing chamber;

a reagent dispenser for dispensing the reagent into said mixing chamber in a main dispensing direction (H);

a reagent-receiving arrangement for receiving the reagent dispensed into said mixing chamber;

said reagent-receiving arrangement including a plurality of reagent receivers disposed one behind another in said main dispensing direction (H);

each one of said plurality of reagent receivers defining a reagent-receiving area positioned to face toward said reagent dispenser;

at least two of said reagent receivers being directly adjacent to one another in said main dispensing direction (H), the reagent-receiving area of the reagent receiver of said at least two of said reagent receivers positioned closer to said reagent dispenser being completely overlapped at right angles to said main dispensing direction (H) by the reagent-receiving area of the reagent receiver of said at least two of said reagent receivers positioned further away from said reagent dispenser;

a size of the reagent-receiving areas of the respective reagent receivers increasing in said main dispensing direction (H);

an outer peripheral contour of the reagent-receiving arrangement corresponding to an outer peripheral contour of the reagent receiver having the largest reagent-receiving area; and said reagent dispenser having a dispensing location (O) positioned in each direction at right angles to said main dispensing direction (H) centrally with respect to said outer peripheral contour of the reagent-receiving arrangement.

15. The exhaust system of claim 14, further comprising at least one of the following:

i) a first exhaust-gas treatment arrangement disposed upstream of said mixing section; and, ii) a second exhaust-gas treatment arrangement disposed downstream of said mixing section.

16. The exhaust system of claim 15, wherein said first exhaust-gas treatment arrangement includes an oxidation catalytic converter and/or a particle filter; and, said second exhaust-gas treatment arrangement includes an SCR catalytic converter.

17. A mixing section for an exhaust system of an internal combustion engine, the mixing section being for intermixing exhaust gas and reagent, the mixing section comprising:

a mixing-section housing enclosing a mixing chamber and having a housing base;

a reagent dispenser for dispensing the reagent into said mixing chamber in a main dispensing direction (H);

said housing base having two exhaust-gas inlet openings for admitting exhaust gas into said mixing chamber, each one of said exhaust-gas inlet openings defining a respective longitudinal axis and being elongated in the direction of said longitudinal axis which is parallel to said main dispensing direction (H), said longitudinal axes overlapping one another;

a reagent-receiving arrangement for receiving the reagent dispensed into said mixing chamber;

said reagent-receiving arrangement including a plurality of reagent receivers disposed one behind another in said main dispensing direction (H);

each one of said plurality of reagent receivers defining a reagent-receiving area positioned to face toward said reagent dispenser;

said mixing-section housing having an exhaust-gas-deflecting wall situated opposite said housing base and defining a concave inner deflecting surface facing toward said mixing chamber;

said concave inner deflecting surface exhibiting a vertex region(S) with maximum spacing from said housing base; and a vertical projection of the vertex region(S) onto said housing base being situated centrally between said two exhaust-gas inlet openings.

18. The mixing section of claim 17, wherein said vertex region(S) is elongated in the direction of said longitudinal axes of said exhaust-gas inlet openings and/or in the direction of the main dispensing direction (H).

19. An exhaust system for an internal combustion engine comprising: a conduit for conducting exhaust gas away from said internal combustion engine; and, a mixing section for intermixing exhaust gas and a reagent; said mixing section including:

a mixing-section housing enclosing a mixing chamber and having a housing base;

a reagent dispenser for dispensing the reagent into said mixing chamber in a main dispensing direction (H);

said housing base having two exhaust-gas inlet openings for admitting exhaust gas into said mixing chamber, each one of said exhaust-gas inlet openings defining a respective longitudinal axis and being elongated in the direction of said longitudinal axis which is parallel to said main dispensing direction (H), said longitudinal axes overlapping one another;

a reagent-receiving arrangement for receiving the reagent dispensed into said mixing chamber;

said reagent-receiving arrangement including a plurality of reagent receivers disposed one behind another in said main dispensing direction (H);

each one of said plurality of reagent receivers defining a reagent-receiving area positioned to face toward said reagent dispenser;

said mixing-section housing having an exhaust-gas-deflecting wall situated opposite said housing base and defining a concave inner deflecting surface facing toward said mixing chamber;

said concave inner deflecting surface exhibiting a vertex region(S) with maximum spacing from said housing base; and a vertical projection of the vertex region(S) onto said housing base being situated centrally between said two exhaust-gas inlet openings.

* * * * *